US006763912B2

(12) United States Patent
Robinson et al.

(10) Patent No.: US 6,763,912 B2
(45) Date of Patent: Jul. 20, 2004

(54) MODULAR STAIR ASSEMBLY

(75) Inventors: Robby C. Robinson, Lake Charles, LA (US); Gerukl M. McCombs, Sulphur, LA (US)

(73) Assignee: Century Group, L.L.C., Sulphur, LA (US)

( * ) Notice: Subject to any disclaimer, the term of this patent is extended or adjusted under 35 U.S.C. 154(b) by 0 days.

(21) Appl. No.: 10/230,855

(22) Filed: Aug. 29, 2002

(65) Prior Publication Data

US 2004/0040785 A1 Mar. 4, 2004

(51) Int. Cl.[7] ..... E06C 7/16

(52) U.S. Cl. ..... 182/115; 182/113; 182/151; 52/182

(58) Field of Search ..... 182/115, 116, 182/113, 151; 52/182–191

(56) References Cited

U.S. PATENT DOCUMENTS

| | | | | |
|---|---|---|---|---|
| 307,551 | A | | 11/1884 | Jackson |
| 569,464 | A | | 10/1896 | Moore |
| 750,156 | A | | 1/1904 | Bois |
| 838,266 | A | | 12/1906 | McKee et al. |
| 960,412 | A | | 6/1910 | Sandblom |
| 1,063,216 | A | | 6/1913 | Rendle et al. |
| 1,475,777 | A | | 11/1923 | Ballenger |
| 1,835,759 | A | | 12/1931 | Cook |
| 1,888,686 | A | | 11/1932 | O'Donnell |
| 2,150,586 | A | | 3/1939 | McAver |
| 2,205,859 | A | | 6/1940 | O'Donnell |
| 2,218,523 | A | | 10/1940 | Byington |
| 2,281,698 | A | | 5/1942 | Kogl |
| 2,287,561 | A | * | 6/1942 | Page |
| 2,696,027 | A | | 12/1954 | Ryland |
| 2,949,703 | A | | 8/1960 | Katzmarek |
| 3,196,997 | A | | 7/1965 | Hager |
| 3,747,708 | A | | 7/1973 | Wenger et al. |
| 3,750,351 | A | | 8/1973 | Greenburg |
| 4,042,064 | A | * | 8/1977 | Lobb |
| 4,464,870 | A | | 8/1984 | Crepeau |
| 4,580,777 | A | * | 4/1986 | Johnson |
| 4,635,416 | A | | 1/1987 | Ayala |
| 4,819,391 | A | | 4/1989 | Tassin et al. |
| 4,823,529 | A | * | 4/1989 | Canfield |
| 4,873,802 | A | | 10/1989 | Dahowski |
| 5,293,722 | A | | 3/1994 | Reimann |
| 5,778,610 | A | | 7/1998 | Berg |
| 5,806,254 | A | | 9/1998 | Bennett |
| 5,833,576 | A | * | 11/1998 | Henni |
| 5,899,032 | A | | 5/1999 | Buzby |
| 6,205,722 | B1 | * | 3/2001 | Bromley |
| 6,295,772 | B1 | | 10/2001 | Whitson |

* cited by examiner

*Primary Examiner*—Alvin Chin-Shue
(74) *Attorney, Agent, or Firm*—Haynes and Boone, LLP

(57) ABSTRACT

A modular stair assembly includes a stair module and at least one of a transportation module, deck module, handrail module, extension deck module, and extension handrail module that can be interconnected in various configurations to suite a wide variety of different applications.

9 Claims, 10 Drawing Sheets

MODULAR STAIR ASSEMBLY

BACKGROUND OF THE INVENTION

This invention relates to stair assemblies, and more particularly to modular stair assemblies with different modules or components that can be connected together to suit a wide variety of different applications.

Prefabricated stair assemblies are often designed for a single application or particular use. For example, it is common to prefabricate stair assemblies for new homes, trailer homes, and so on. These stair assemblies are typically constructed of cement, and are therefore relatively heavy in weight, difficult to transport, position, and secure in place. The removal of such stair assemblies is labor-intensive and often requires special equipment. For temporary structures or structures at temporary locations, such as platforms for presentations or speeches, trailer homes, and so on, the ability to install and/or remove the stair assembly for various applications in a quick and efficient manner is desirous.

BRIEF SUMMARY OF THE INVENTION

In accordance with one aspect of the invention, a modular stair assembly comprises a stair module having a pair of spaced stair support frames with each stair support frame including an elongate base member, a rear upright support member connected to a rear end of the base member, a stringer extending diagonally from a forward end of the base member to an upper end of the rear support member, and a plurality of L-shaped risers connected to the stringer. Each riser has a vertical riser portion that extends upwardly from the stringer and a horizontal riser portion that extends rearwardly from the vertical riser portion toward the stringer. The vertical and horizontal riser portions are rigidly fixed together. A plurality of steps extend between the stair support frames and are supported by the horizontal riser portions.

In accordance with a further aspect of the invention, at least one of a transportation module, deck module, handrail module, extension deck module, and extension handrail module can be provided with the stair module so that the modular stair assembly is readily adaptable to a wide variety of different applications.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

The invention will now be described in greater detail with reference to the drawings, wherein like parts throughout the drawing figures are represented by like numerals.

DETAILED DESCRIPTION OF THE INVENTION

Figure 1:
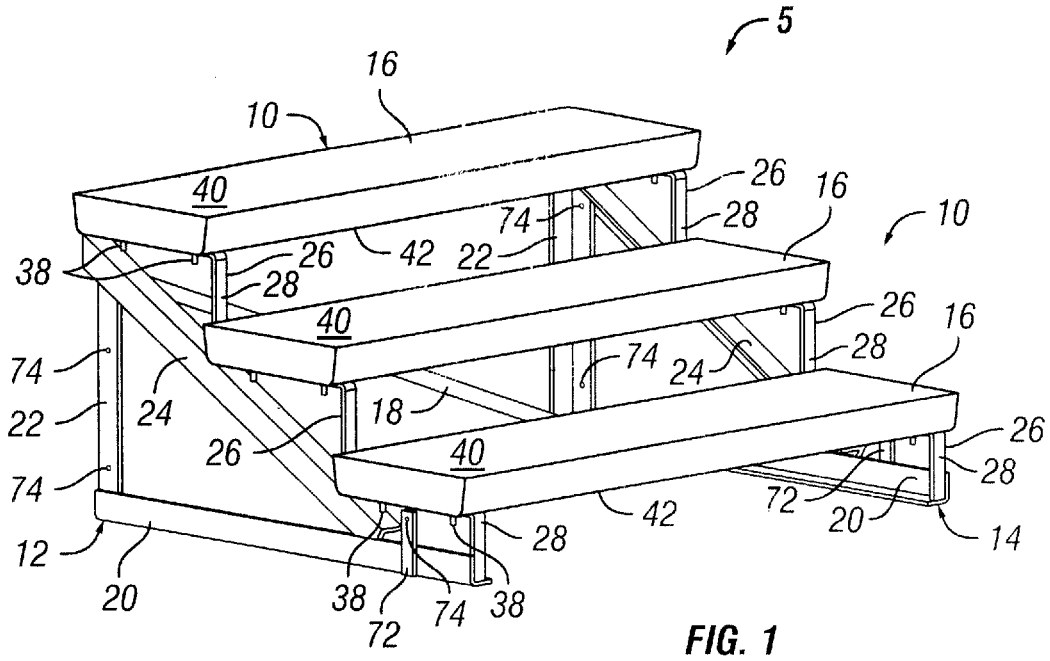
FIG. 1 is an isometric view of a modular stair assembly according to a first embodiment of the present invention.

Referring now to the drawings, and to FIG. 1 in particular, a modular stair assembly 5 in accordance with the present invention is illustrated. The modular stair assembly includes a stair module 10 with a pair of spaced stair support frames 12 and 14, a plurality of steps 16 extending between the support frames, and a cross member or brace 18 extending diagonally between the support frames 12 and 14 for added structural support.

Figure 6:
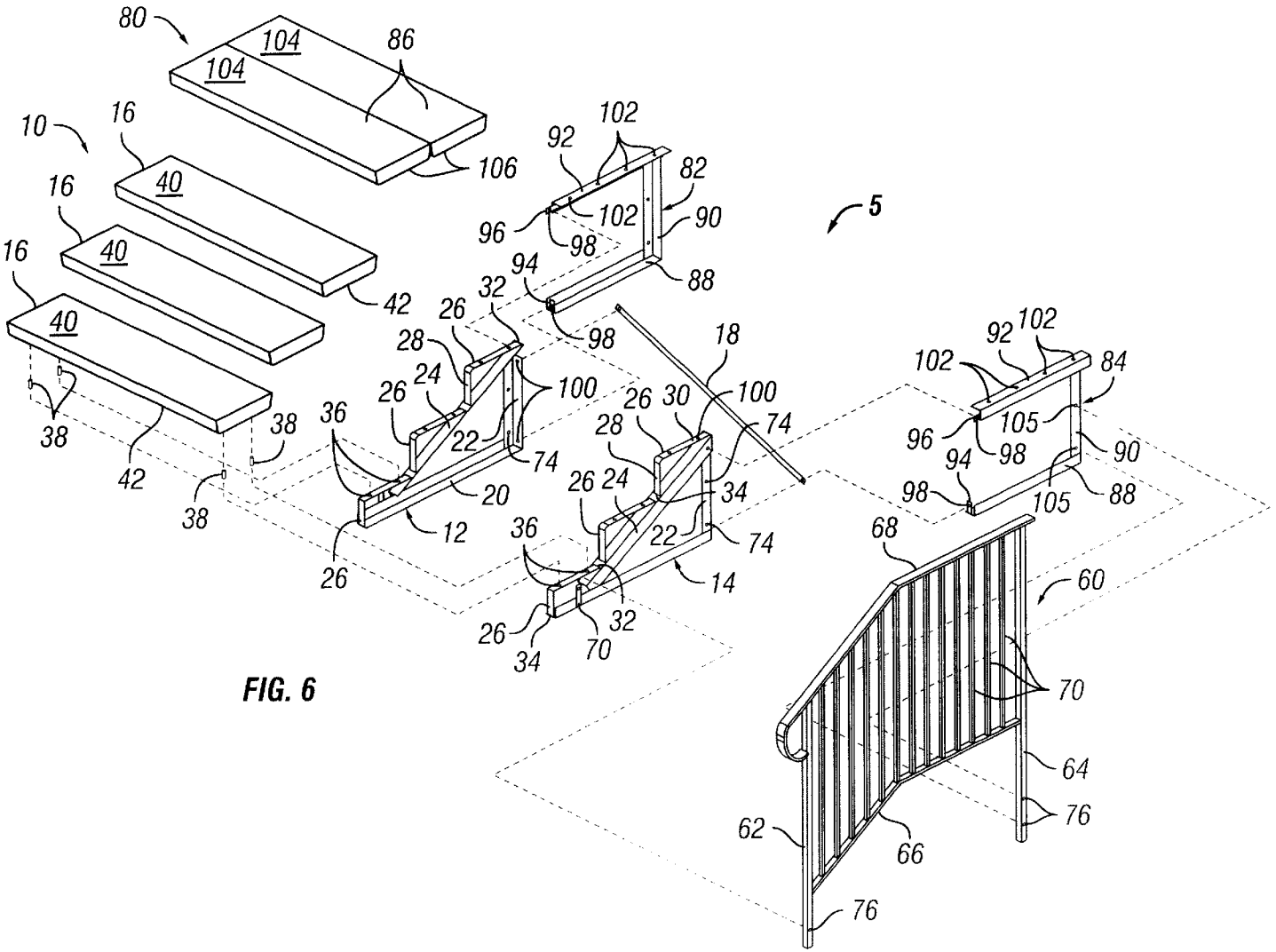
FIG. 6 is an isometric exploded view of the modular stair assembly of FIG. 5 as viewed from the left side thereof.

With additional reference to FIG. 6, each of the stair support frames 12 and 14 is generally triangular in shape and includes an elongate base member 20 that contacts a horizontal support surface, such as a floor, platform, ground, and so on, a rear upright support member 22 connected to a rear end of the base member 20, and a stringer 24 extending diagonally from a forward end of the base member 20 to an upper end of the rear support member 22. Preferably, the base member 20, the rear upright support member 22 and the stringer 24 are L-shaped in cross section and formed of a metal material, such powder-coated steel or anodized aluminum to inhibit rust and/or discoloration. It will be understood that the structural members can be constructed with other materials and/or finishes. A plurality of L-shaped risers 26 are connected to the stringer 24 for supporting the steps 16. Each riser 26 is preferably constructed of a single piece of material and includes a vertical riser portion 28 and a horizontal riser portion 30 that is rigidly connected to the vertical riser portion. With the exception of the forward-most riser 26, the ends 32 and 34 of the risers 26 are securely connected to the stringer, preferably through welding, although fasteners, brackets, or other securing means can be used. As shown, the forward-most riser 26 has one end 32 that is also connected to the stringer 24 and another end 34 that is connected to the forward end of the base member 20 at a more forward position than the stringer 24. Each of the horizontal riser portions 30 includes a pair of spaced apertures 36 through which threaded bolts or studs 38 are received for securing the steps 16 to the risers 26.

The steps 16 are preferably trapezoidal in shape with an upper surface 40 that is wider than a lower surface 42. Each step 16 is preferably constructed of a slip-resistant cement material with the studs 38 embedded therein and extending downwardly from the lower surface 42. It will be understood that the steps 16 can be constructed of other materials and shapes.

With the above-described arrangement, the stair module 10 is relatively light weight, rigid, and easily transported and erected when the individual components are shipped separately and bolted or otherwise connected together at the installation site. When the stair module 10 is used for temporary structures or displays, the bolted configuration allows for relatively quick and easy disassembly.

Figure 2:
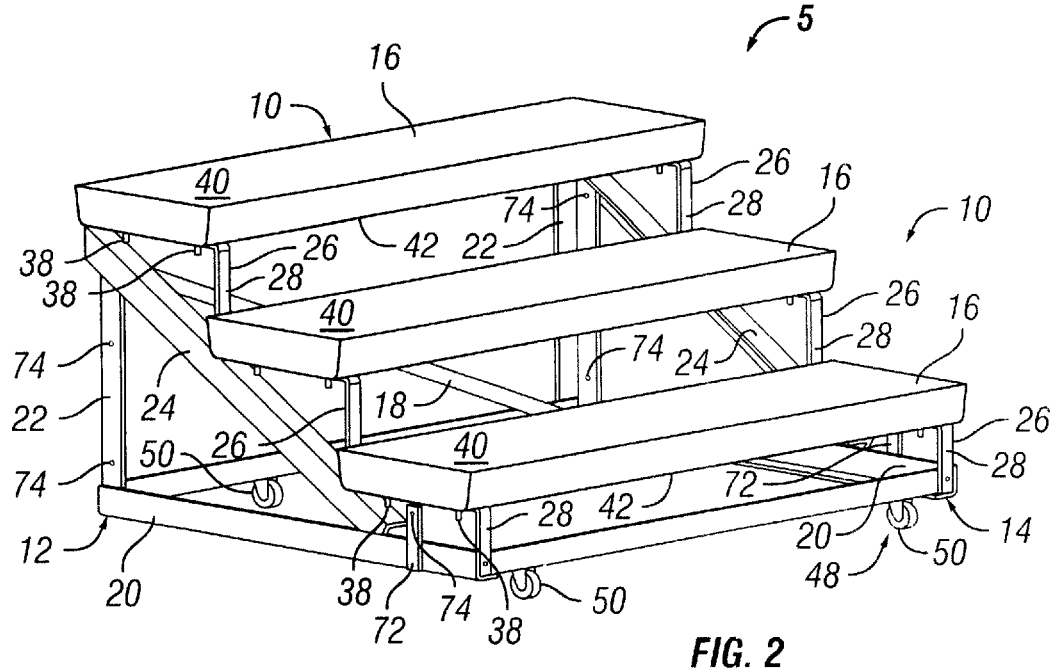
FIG. 2 is an isometric view of the modular stair assembly with an attached transportation module in accordance with the invention.

With reference now to FIG. 2, a transportation module 48 in the form of wheels or casters 50 can be connected to the base members 20 of the support frames 12 and 14 to facilitate movement and positioning of the modular stair assembly 5. This configuration is especially advantageous when the modular stair assembly 5 is installed at temporary locations or must be moved for accessing or preventing access to different parts of a structure. The wheels 50 can be of the locking and/or swiveling type. The wheels 50 may additionally or alternatively be of the retracting type so that the frame can be solidly supported on a surface when positioned at a desired location.

Figure 3:
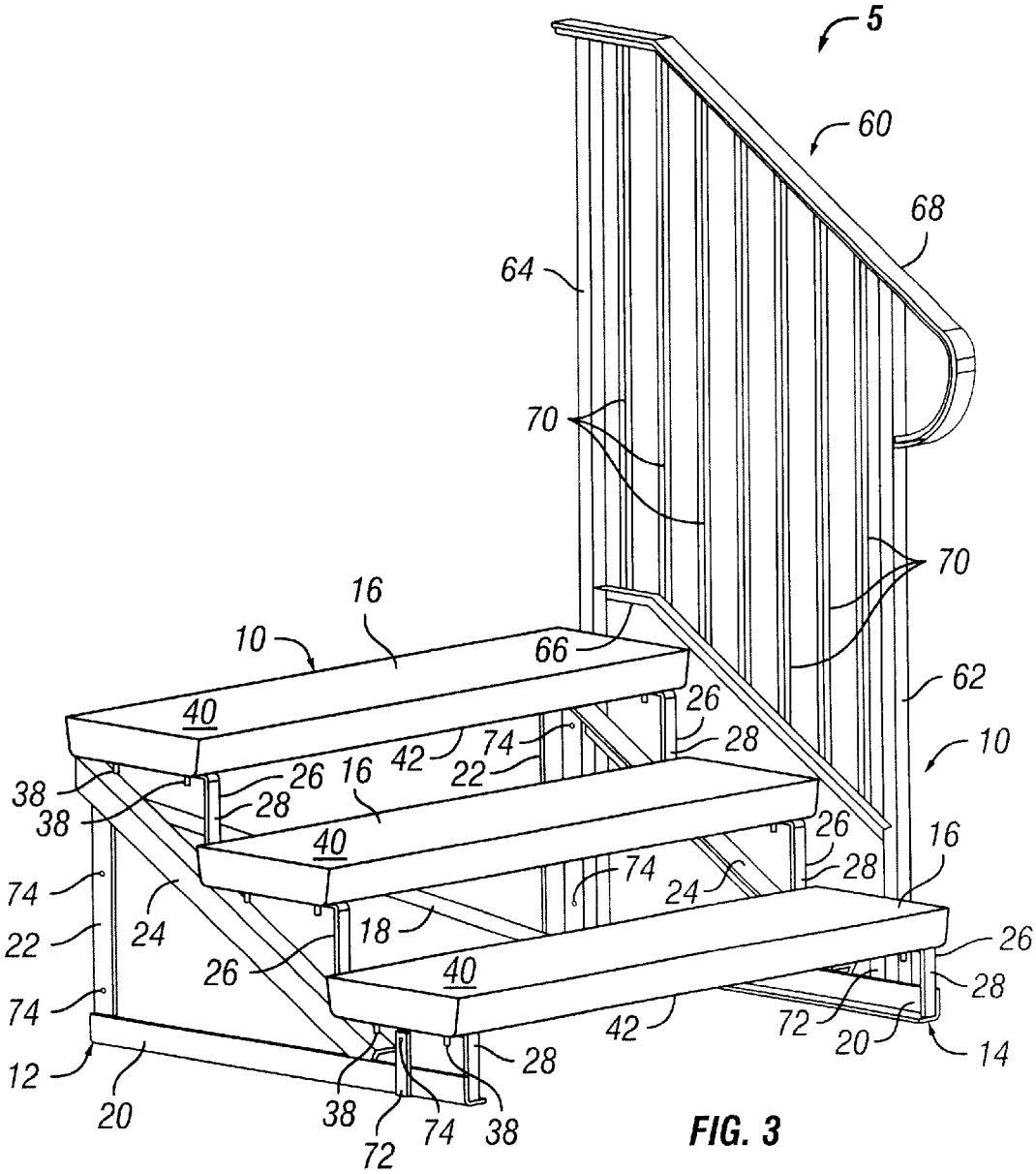
FIG. 3 is an isometric view of the modular stair assembly with an attached handrail module in accordance with the invention.

With reference now to FIGS. 3 and 6, the modular stair assembly 5 can include a handrail module 60. As shown, the handrail module 60 has a front upright post 62, a rear upright post 64, a lower support bar 66 that extends between the front and rear posts, an upper rail 68 that connects to and extends beyond the front and rear posts, and spindles 70 that extend between the lower support bar 66 and the upper rail 68. The components of the handrail module 60 are preferably constructed of a durable material, such as steel or aluminum, and can be separately formed and rigidly connected together through welding, fasteners, or other attachment means. Alternatively, the handrail module 60 may be formed as a unitary structure of plastic or other material. The front upright post 62 is preferably connected to a front mounting tab 72 that is rigidly connected to and extends upwardly from the base member 20 of each support frame 12, 14. The rear upright post 64 is preferably connected to the rear upright support member 22 of one of the support frames 12, 14. The rear upright support members 22 and the front mounting tabs 72 preferably have mounting holes 74 that are in alignment with holes 76 (FIG. 6) on the front and rear posts 62 and 64, respectively, for receiving a bolt or other fastener to thereby secure the handrail module 60 to one or both of the support frames 12, 14.

Figure 4:
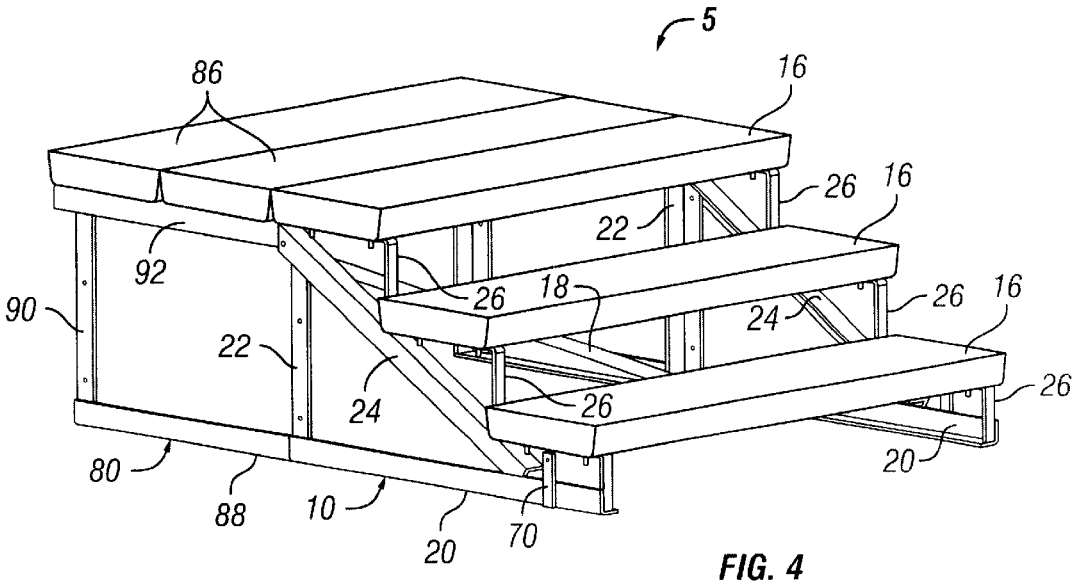
FIG. 4 is an isometric view of the modular stair assembly with an attached deck module in accordance with the invention.
Figure 7:
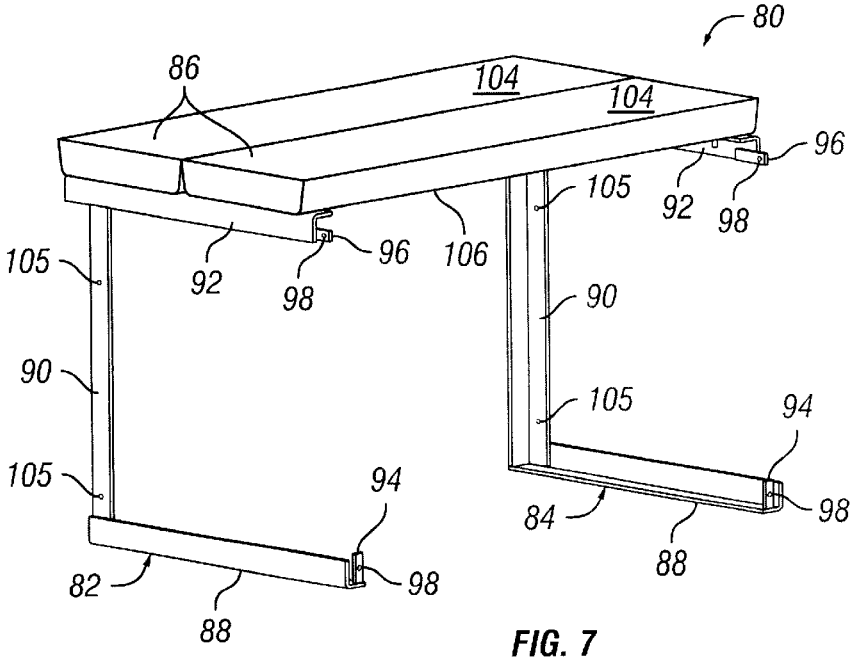
FIG. 7 is an isometric view of the deck module.

With reference now to FIGS. 4, 6 and 7, the modular stair assembly 5 can include a deck module 80. As shown, the deck module 80 has a pair of spaced deck frames 82 and 84 and a plurality of platform portions 86 extending between the deck frames. Although not shown, a cross member can extend diagonally between the deck frames 82 and 84 for added structural support.

Each of the deck frames 82 and 84 is of generally C-shaped configuration and includes a lower support member 88, a rear upright support member 90 connected to a rear end of the lower support member 88, and an upper support member 92 connected to an upper end of the upright support member 90. Preferably, the lower, upper and rear upright support members are L-shaped in cross section and formed of a metal material, such powder-coated steel or anodized aluminum to inhibit rust and/or discoloration. A lower connection tab 94 is secured to a forward end of each of the lower support members 88 and extends generally upwardly therefrom. An upper connection tab 96 is secured to a forward end of each of the upper support members 92 and extends generally forwardly therefrom. A hole 98 is preferably formed in each of the connection tabs 94, 96 and corresponding holes 100 (FIG. 6) are preferably formed in the rear upright support members 22 through which threaded bolts or other fasteners are received for securing the deck module 80 to the stair module 10. It will be understood that the deck module can be connected to the stair module through other fastening means, such as clamping, welding, adhesive bonding, and so on.

Each of the upper support members 92 preferably includes pairs of spaced apertures 102 through which threaded bolts or studs (not shown) are received for securing the platform portions 86 to the upper support members 92. It will be understood that more or less pairs of spaced apertures 102 can be used depending on the length of the deck module 80 and thus the total number of platform portions 86. As with the rear upright support members 22 of the stair support frames 12 and 14, the rear upright support members 90 of the deck frames 82 and 84 have mounting holes 105 that are in alignment with holes 76 (FIG. 6) on the rear posts 64 of the handrail module 60 for receiving a bolt or other fastener to thereby secure the handrail module 60 to one or both of the stair support frames 12, 14 and the deck frames 82, 84. It will be understood that the structural members can be constructed with other materials and/or finishes. It will be further understood that the deck frames are not limited to the C-shaped configuration.

The platform portions 86 are preferably similar in construction to the steps 16 and are preferably trapezoidal in shape with an upper surface 104 that is wider than a lower surface 106. Each platform portion 86 is preferably constructed of a slip-resistant cement material with studs (not shown) embedded therein and extending downwardly from the lower surface 106. It will be understood that the platform portions 86 can be constructed of other materials and shapes.

Figure 9:
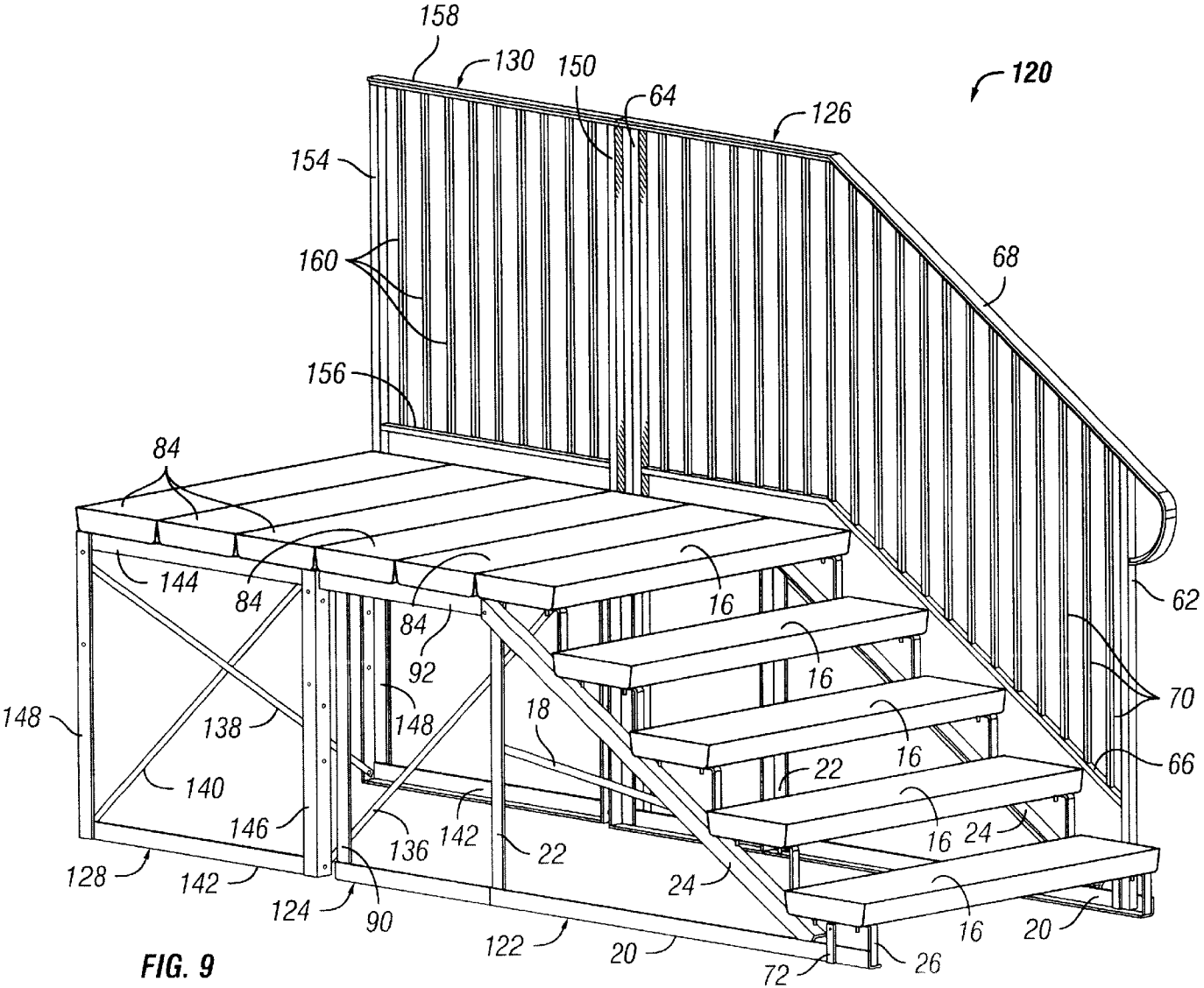
FIG. 9 is an isometric view of a modular stair assembly with an attached extension deck module and extension handrail module in accordance with a further embodiment of the invention.

Although only three steps 16 and two platform portions 86 are shown for the stair and deck modules, respectively, it will be understood that more or less steps and/or platform portions can be used, it being understood that the structural members would be lengthened and/or shortened to accommodate the different numbers of steps and/or platform portions, as shown for example in FIG. 9.

Figure 5:
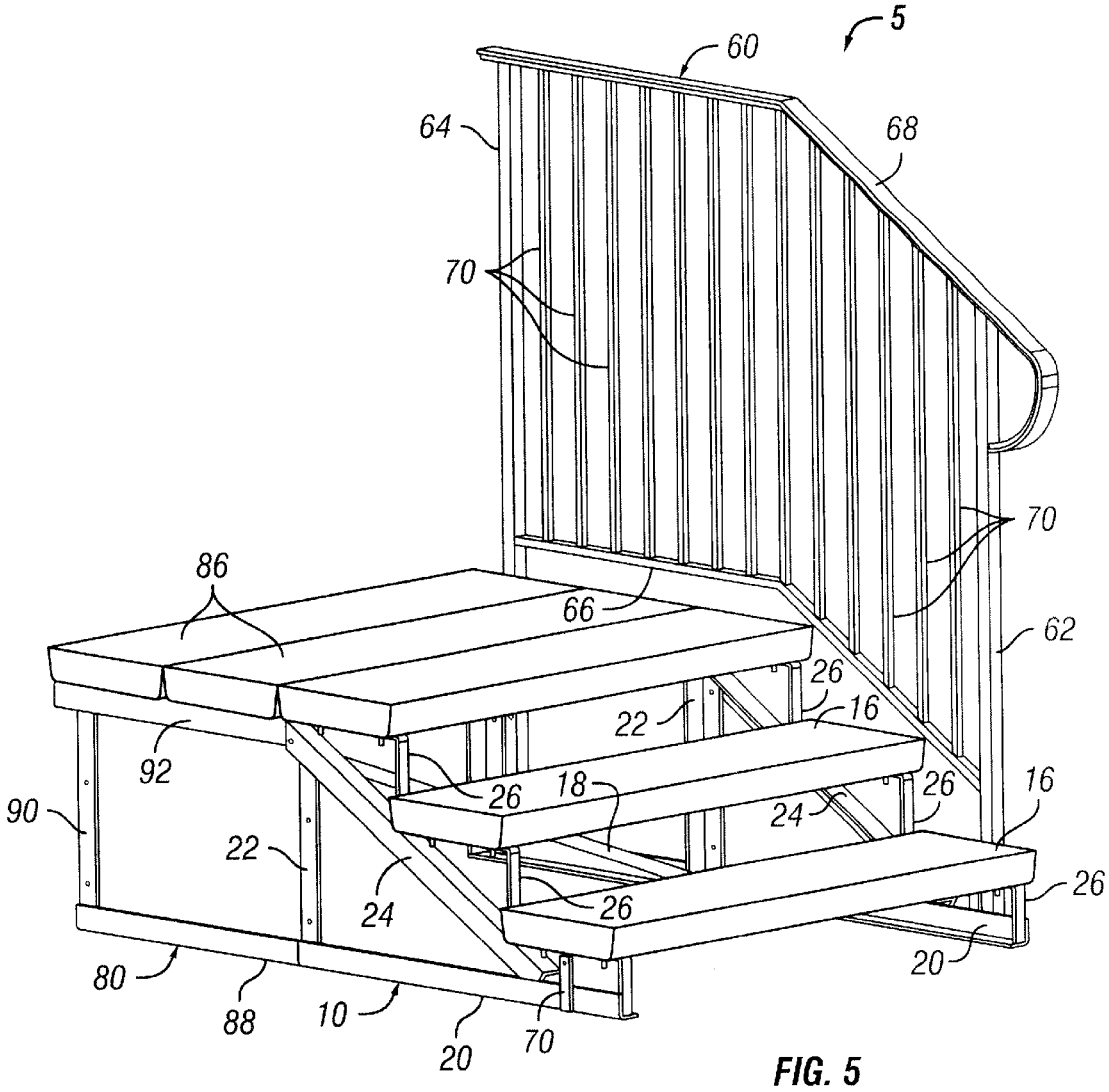
FIG. 5 is an isometric view of the modular stair assembly with attached deck and handrail modules in accordance with the invention.

The modular stair assembly 5 can include one or more of the modules as previously described. As shown in FIG. 1, the modular stair assembly includes the stair module 10. In FIG. 2, a transportation module 48 is added. In FIG. 3, the modular stair assembly 5 includes a combination of the stair module 10 and the handrail module 60. In FIG. 4, the modular stair assembly includes a combination of the stair module 10 and the deck module 80. In FIGS. 5 and 6, the modular stair assembly includes a combination of the stair module 10, the handrail module 60, and the deck module 80. Other combinations of the different modules can be used depending on the particular requirements at the installation site.

Figure 8:
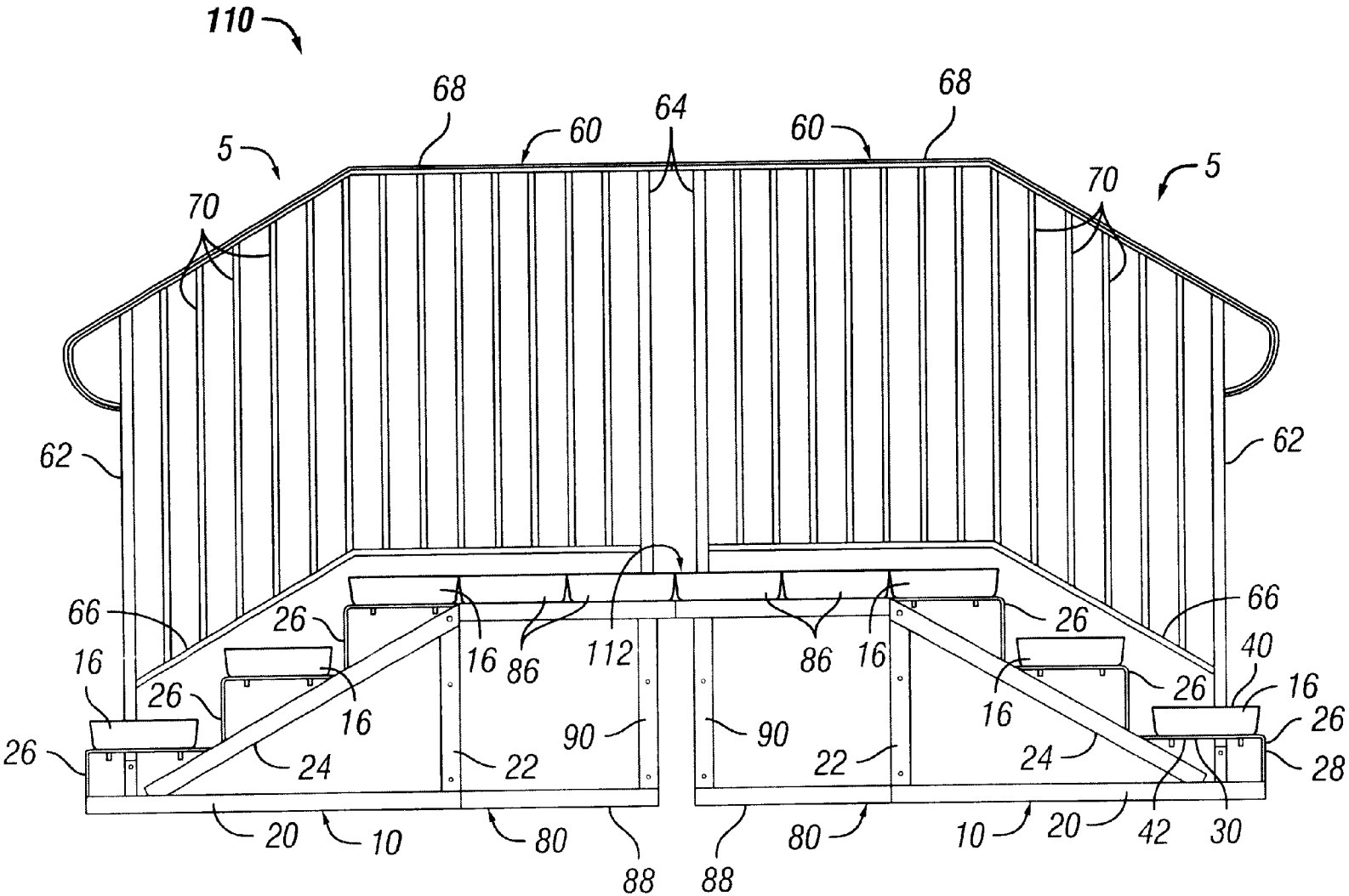
FIG. 8 is a side elevational view of a pair of modular stair assemblies in back-to-back relationship.

With reference now to FIG. 8, a modular stair assembly 110 in accordance with a further embodiment of the invention includes two modular stair assemblies 5 in back-to-back relation to form a raised platform 112 that can be accessed from either stair module 10. As in the previous embodiment, each of the stair assemblies 5 may be arranged with a single stair module 10 or different combinations of modules to produce the desired effect.

Figure 11:
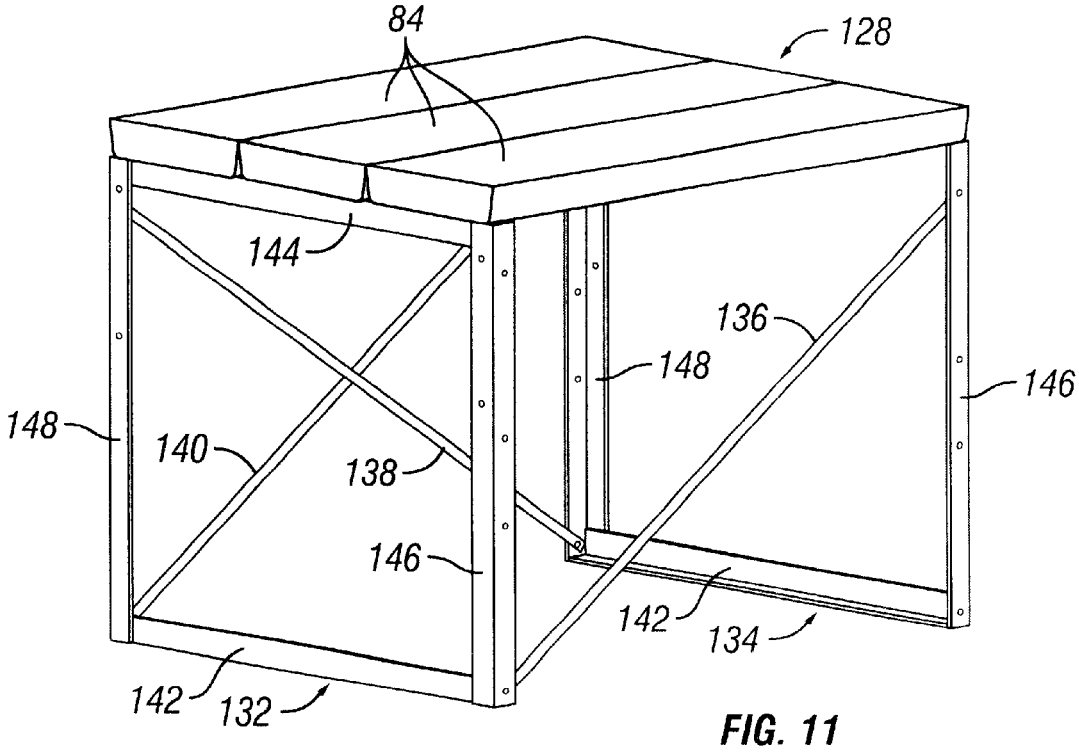
FIG. 11 is an isometric view of the extension deck module as shown in the FIG. 10 embodiment.

Referring now to FIGS. 9 and 11, a modular stair assembly 120 in accordance with a further embodiment of the invention includes a stair module 122, a deck module 124 connected to a rear end of the stair module, a handrail module 126 connected to a forward end of the stair module 122 and a rearward end of the deck module 124, an extension deck module 128 connected to a rear end of the deck module 124, and an extension handrail module 130 connected to a side of the extension deck module 128. The stair module 122, deck module 124 and handrail module 126 are similar in construction to the stair module 10, deck module 80 and handrail module 60, respectively, with the exception that some of the structural components are lengthened to accommodate an increased height of the stair module 122 and the increased number of steps 16. The size of the structural components may also be increased to accommodate more weight.

The extension deck module 128 has a pair of spaced extension deck frames 132 and 134, cross members 136, 138 and 140 extending diagonally between the extension deck frames 132 and 134, and a plurality of platform portions 86 extending between the extension deck frames.

Each of the extension deck frames 132 and 134 is preferably generally square or rectangular in shape and includes a lower support member 142, an upper support member 144, a front upright support member 146 and a rear upright support member 148 extending between forward and rearward portions, respectively, of the lower support member 142 and the upper support member 144. Preferably, the lower, upper, front and rear support members are L-shaped in cross section and formed of a metal material, such powder-coated steel or anodized aluminum. It will be understood that the support members can be constructed of other cross sectional shapes and/or materials.

As shown, the cross member 136 extends diagonally from a lower portion of the front upright support member 146 of the extension deck frame 132 to an upper portion of the front upright support member 146 of the extension deck frame 134. Likewise, the cross members 138 and 140 extend diagonally from a lower portion of one of the rear upright support members 148 to an upper portion of the other rear upright support member 148. Although three cross members are shown, it will be understood that more or less cross members can be provided.

As with the deck module 80, each of the upper support members 144 of the extension deck module 128 preferably includes pairs of spaced apertures (not shown) through which threaded bolts or studs (not shown) are received for securing the platform portions 86 to the upper support members 144. It will be understood that more or less pairs of spaced apertures can be used depending on the length of the extension deck module 128 and thus the total number of platform portions 86.

The extension deck module 128 is preferably connected to the rear of the deck module 124 through fasteners, such as threaded bolts and nuts, but may alternatively be connected through clamping, welding, adhesive bonding, or other fastening means.

As shown in FIG. 9, the extension handrail module 130 has a front upright post 150, a rear upright post 154, a lower support bar 156 that extends between the front and rear posts, an upper rail 158 that extends between the front and rear posts, and spindles 160 that extend between the lower support bar 156 and the upper rail 158. The components of the extension handrail module 130 are preferably constructed of a durable material, such as steel or aluminum, and can be separately formed and rigidly connected together through welding, fasteners, or other attachment means. Alternatively, the extension handrail module 130 may be formed as a unitary structure of plastic or other material. The front upright post 150 is preferably connected to the front upright support member 146 of one or both support frames 132, 134 (FIG. 11) Likewise, the rear upright post 154 is preferably connected to the rear upright support member 148 of one or both support frames 132, 134 through fasteners, such as threaded bolts and nuts, but may alternatively be connected together through clamping, welding, adhesive bonding, or other fastening means. The use of two or more extension handrail modules with the extension deck module 128 is contemplated.

With the above-described embodiment, one or more stair modules 122, deck modules 124, handrail modules 126, extension deck modules 128, and/or extension handrail modules 130 can be connected together in different combinations and orientations to accommodate a wide variety of circumstances and applications. As in the FIG. 8 embodiment, two modular stair assemblies 120 can be positioned in back-to-back relation to form an extended raised platform that can be accessed from both stair modules 122.

Figure 10:
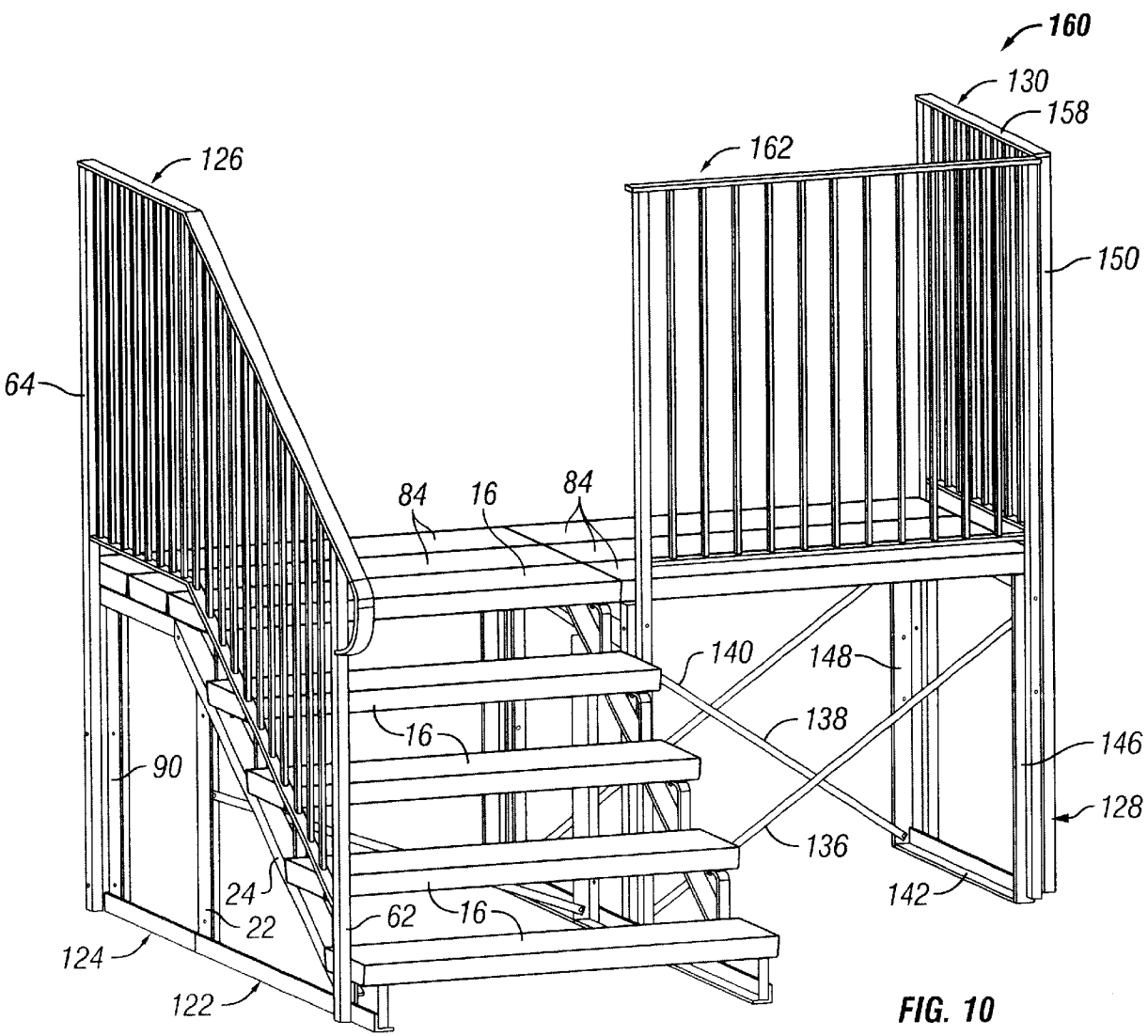
FIG. 10 is an isometric view of a modular stair assembly with an extension deck module and a pair of extension handrail modules in accordance with an even further embodiment of the invention.

With reference now to FIG. 10, a modular stair assembly 160 in accordance with a further embodiment of the invention is illustrated. The modular stair assembly 160 is similar in construction to the modular stair assembly 120 previously described, with the exception that the extended deck module 128 is connected to a side of the deck module 124 and a second extension handrail module 162 is connected to a forward portion of the extended deck module 128. The handrail module 126 is also repositioned on an opposite side of the stair module 122 and the deck module 124.

With the above-described embodiments, it can be readily seen that the modular stair assembly can be configured in a wide variety of different ways to accommodate a wide variety of different applications.

Figure 12:
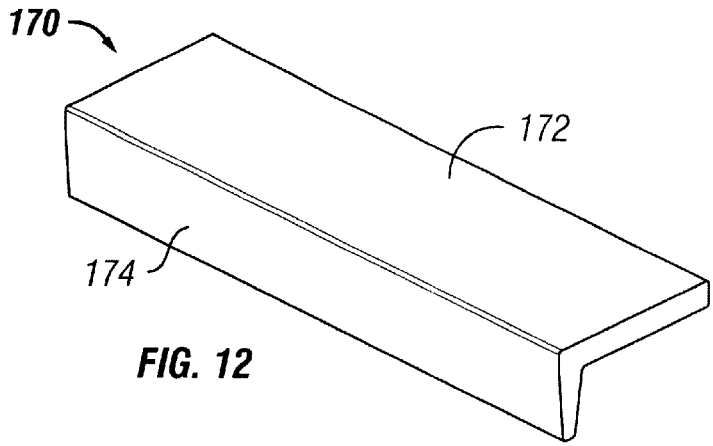
FIG. 12 is a left side isometric view of a stair step in accordance with the invention that can form part of the modular stair assemblies of the previous embodiments.
Figure 13:
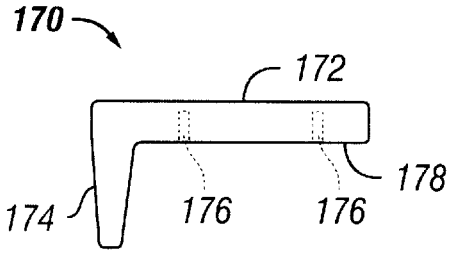
FIG. 13 is a side elevational view of the stair step.
Figure 14:
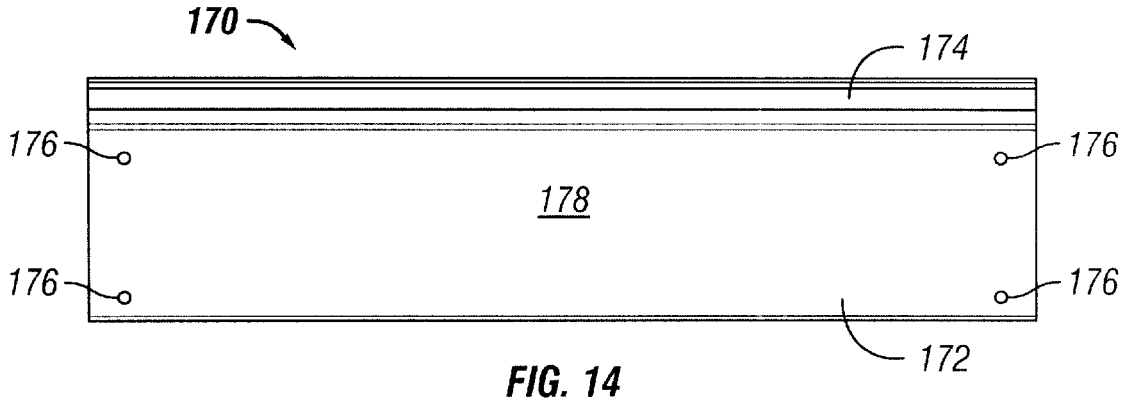
FIG. 14 is a bottom plan view of the stair step.

Turning now to FIGS. 12–14, a step 170 in accordance with a further embodiment of the invention is illustrated. The step 170 can be used with any of the stair modules of the previously described embodiments and includes a tread portion 172 and an overhang portion 174 that extends generally downwardly from the tread portion 172. Openings 176 are formed in a lower surface 178 of the tread portion 172. The openings 176 are adapted to receive threaded studs or bolts (not shown) for connecting the steps 170 with the risers 26 as previously described. Alternatively, studs, bolts, clamps, or other fastening means can be integrally molded with the steps 1700 for connection with the risers 26. The step 170 is preferably constructed of a slip-resistant cement material, although other materials may be used.

It will be understood that terms of orientation and/or position as may be used herein such as vertical, horizontal, front, rear, upper, lower, and so on, as well as their respective derivatives and equivalent terms refer to relative, rather than absolute, orientations and/or positions. Moreover, it will be understood that the term "preferably" as used herein refers to an exemplary arrangement of the invention, and therefore is not intended to portray the invention in any limiting sense.

It will be appreciated by those skilled in the art that changes could be made to the embodiments described above without departing from the broad inventive concept thereof. It will be understood, therefore, that this invention is not limited to the particular embodiments disclosed, but it is intended to cover modifications within the spirit and scope of the present invention as defined by the appended claims.

We claim:

1. A modular stair assembly, comprising:

a stair module supportable and freestanding on a surface, the stair module having a plurality of steps removably connected between a pair of spaced side frames; and a plurality of optional modules removably connected to the stair module to result in different structures of the stair assembly to suit a wide variety of applications, the optional modules comprising a deck module, wherein the deck module comprises:

a generally horizontal platform portion substantially coplanar to an uppermost step of the stair module; and a pair of spaced C-shaped side frames each having, a generally, horizontally extending bottom member having a free proximal end supportable on a surface, a generally, horizontally extending top member having a free proximal end supporting the platform portion, a generally vertical member extending between distal ends of the bottom and top members, and connection tabs extending from the proximal ends of the bottom and top members for removably engaging the side frames of the stair module.

2. The modular stair assembly of claim 1, wherein the plurality of optional modules further includes an extension deck module having a generally horizontal platform portion substantially coplanar to the platform portion of the deck module.

3. The modular stair assembly of claim 2, wherein the plurality of optional modules further includes a handrail module removably connectable to the stair module and an extension handrail module removably connectable to the extension deck module.

4. The modular stair assembly of claim 1, wherein the plurality of optional modules further includes a handrail module that extends in a generally horizontal direction a length generally coterminous with the side frames of the stair module.

5. The modular stair assembly of claim 1, wherein the plurality of optional modules further includes a handrail module that extends in a generally horizontal direction a length generally coterminous with a length defined by the stair module connected to the deck module.

6. A modular stair assembly, comprising:

a stair module supportable and freestanding on a surface, the stair module having a plurality of steps removably connected between a pair of spaced side frames;

a module removably connected to the stair module wherein the module is a first handrail module extending in a generally horizontal direction a length generally coterminous with the side frames of the stair module, or a deck module, the deck module comprising:

a generally horizontal platform portion substantially coplanar to an uppermost step of the stair module; and a pair of spaced C-shaped side frames each having a generally, horizontally extending bottom member having a free proximal end supportable on a surface, a generally, horizontally extending top member having a free proximal end supporting the platform portion, a generally vertical member extending between distal ends of the bottom and top members, and connection tabs extending from the proximal ends of the bottom and top members removably engaging the side frames of the stair module; and optionally a second handrail module removably connected to the stair module and removably connected to the deck module, the second handrail module extending in a generally horizontal direction a length generally coterminous with a length defined by the stair module connected to the deck module.

7. The modular stair assembly of claim 6 wherein the deck module is removably connected to an extension deck module having a generally horizontal platform portion substantially coplanar to the platform portion of the deck module.

8. The modular stair assembly of claim 7 wherein the extension deck module is removably connected to a third handrail module.

9. A modular stair assembly, comprising:

a stair module supportable and freestanding on a surface, the stair module having a plurality of steps removably connected between a pair of spaced side frames; and at least one of a plurality of modules removably connected to the stair module to result in different structures of the stair assembly to suit a wide variety of applications, the plurality of modules comprising:

a first handrail module extending in a generally horizontal direction a length generally coterminous with the side frames of the stair module;

a deck module, the deck module comprising:

a generally horizontal platform portion substantially coplanar to an uppermost step of the stair module; and a pair of spaced C-shaped side frames each having a generally, horizontally extending bottom member having a free proximal end supportable on a surface, a generally, horizontally extending top member having a free proximal end supporting the platform portion, generally vertical member extending between distal ends of the bottom and top members, and connection tabs extending from the proximal ends of the bottom and top members removably engaging the side frames of the stair module; and a second handrail module extending in a generally horizontal direction a length generally coterminous with a length defined by the stair module connected to the deck module.

* * * * *

UNITED STATES PATENT AND TRADEMARK OFFICE

CERTIFICATE OF CORRECTION

PATENT NO. : 6,763,912 B2 
DATED : July 20, 2004
INVENTOR(S) : Robby C. Robinson and Gerald J. McCombs It is certified that error appears in the above-identified patent and that said Letters Patent is hereby corrected as shown below:

Title page,
Item [75], Inventors, please correct as follows:
-- Robby C. Robinson, Lake Charles, LA (US); Gerald M. McCombs, Sulphur, LA (US) --.

Column 6,
Line 50, change "1700" to -- 170 --.

Column 7,
Line 52, delete the comma "," after "module".

Signed and Sealed this

Eighteenth Day of January, 2005

JON W. DUDAS
*Director of the United States Patent and Trademark Office*